US005735135A

United States Patent [19]

Katsuki et al.

[11] Patent Number: 5,735,135

[45] Date of Patent: Apr. 7, 1998

[54] AIR CONDITIONER

[75] Inventors: Hikaru Katsuki, Kiryu; Junichi Goya, Ohizumi-machi; Yasunori Ohama, Ohra-machi; Hideo Maeda; Kiyoshi Kobayashi, both of Ashikaga; Toshimasa Tsukui, Sakai-machi; Masato Inuzuka, Ohizumi-machi, all of Japan

[73] Assignee: Sanyo Electric Co., Ltd., Osaka, Japan

[21] Appl. No.: 826,382

[22] Filed: Apr. 9, 1997

[30] Foreign Application Priority Data

Apr. 10, 1996 [JP] Japan ..... 8-112168
Apr. 10, 1996 [JP] Japan ..... 8-112172

[51] Int. Cl.[6] ..... F25B 5/00

[52] U.S. Cl. ..... 62/259.1; 62/298

[58] Field of Search ..... 62/259.1, 298, 62/499, 504

[56] References Cited

U.S. PATENT DOCUMENTS 3,721,107 3/1973 Stockford et al. ..... 62/298
4,760,707 8/1988 Dennis et al. ..... 62/197
4,766,735 8/1988 Gotou ..... 62/175
5,379,606 1/1995 Katsuki et al. ..... 62/126

*Primary Examiner*—William Doerrler
*Attorney, Agent, or Firm*—Armstrong, Westerman, Hattori, McLeland & Naughton

[57] ABSTRACT

When a single room unit 4 is connected to a compressor 2B of the outdoor unit 1, the room unit 4 is connected to a connection box 29 which is mounted on the outdoor unit 1. Instead, if two room units 5A and 5B must be connected to the outdoor unit 1, a connection box 37 is mounted on the back of the outdoor unit 1. The connection box 37 has branches each having valves 44A and 44B and expansion devices 43A and 43B. The two room units are connected to these branches of the connection box 37. Because of these optional connection boxes, the outdoor unit itself may be constructed in a compact form, and connection of multiple room units to the outdoor unit may be carried out conveniently and correctly in a simple manner.

19 Claims, 15 Drawing Sheets

AIR CONDITIONER

FIELD OF THE INVENTION

The invention relates to an air conditioner, and more particularly, to an air conditioner capable of connecting a variable number of room units in accordance with the demand of a user thereof.

BACKGROUND ART

Air conditioners are often required to selectively connect its outdoor unit to a single room unit having a large refrigeration capacity (hereinafter referred to as large unit) and to a multiplicity of room units having smaller refrigeration capacity (hereinafter referred to as small units), in accordance with the need of the user.

It is then necessary for such an outdoor unit as mentioned above to provide each of the room units with proper amount of refrigerant. To fulfill the requirements of all the room units, it is possible to provide a multiplicity of expansion devices and connection valves equal in number to the maximum allowable number of room units to be connected to the outdoor unit. This will, however, result in an excessively large and costly outdoor unit. If on the other hand a relatively large expansion device is provided in an outdoor unit, it may be replaced on the site by a required number of expansion devices and connection valves when a multiplicity of room units having relatively small power are to be connected. However, piping works for the replacement is very complex and hence liable to errors.

Another disadvantage of an air conditioner capable of connecting a multiplicity of room units with a single outdoor unit, as disclosed in Japanese Patent Publications Nos. 1-20698 and 63-43659, is that it has a refrigerant circuit that sets up only one common refrigeration circuit for all the room units. This type of air conditioner requires complex piping and a complex control system for independent operation of each room unit. That is, in order to provide adequate amount of refrigerant to each of the heat exchanger of each room unit during its operation, the refrigerant circuit has a by-pass circuit that includes a expansion device and an electromagnetic valve at the inlet port and the outlet port of the outdoor unit, respectively. However, when more than two room units are connected in one refrigeration circuit and if one or two of them is/are in inoperative, flow rate(s) of the refrigerant to the remaining room units must be controlled in multiple steps, which requires very complex piping and a complex control circuit. Furthermore, increased flow rate of the refrigerant results in inefficient operation of the air conditioner. The control circuit controlling the flow rate of the refrigerant can be replaced by a control circuit for controlling the frequency of the compressor but it would be costly since the latter control circuit is expensive.

SUMMARY OF THE INVENTION

Therefore, it is an object of the invention to overcome the disadvantages mentioned above by providing an air conditioner which is capable of circulating proper amounts of refrigerant to a multiplicity of room units without resorting to a large outdoor unit.

It is another object of the invention to provide an air conditioner capable of circulating proper amounts of refrigerant to a multiplicity of room units without a complex control circuit nor complex piping, so that the air conditioner may be conveniently and correctly constructed in a simple manner.

Accordingly, there is provided in one aspect of the invention an air conditioner comprising: an outdoor unit having at least one compressor, at least one heat exchanger, at least one expansion device, and tube connectors; at least one room unit having a heat exchanger and tube connectors; and refrigerant tubes for connecting the room unit with the outdoor unit to form a refrigerant circuit, the air conditioner characterized in that the outdoor unit is adapted to be selectively connected to the at least one room unit via a first connection box having refrigerant tubes for connecting the compressor to the room unit; a casing for accommodating therein the refrigerant tubes; and the multiple room unit via a second connection box having a multiplicity of branching refrigerant tubes having a multiplicity of branches each equipped with a valve and a expansion device, and adapted to branch the refrigerant into the room units connected thereto; and a second casing accommodating the branching refrigerant tubes, the first and second connection boxes mountable on an exterior wall of the outdoor unit.

Normally the outdoor unit is furnished with the first connection box. But when a multiplicity of room units must be connected, the first connection box mounted on the outdoor unit is replaced by the second connection box, and then the multiple room units are connected thereto. It should be appreciated that because of this replacement, the outdoor unit still maintains its compact form. In connecting the multiple room units to the compressor of the outdoor unit, the refrigerant tubes of the second connection box are connected with the refrigerant tubes of the outdoor unit, and then the refrigerant tubes of the second connection box with the refrigerant tubes of the multiple room units. This piping work is essentially the same as for connecting a single room unit to the outdoor unit except for the replacement of the first connection box by the second connection box. Hence, there is little room for making erroneous connection of the tubes even when multiple room units are connected, so that piping work is correctly carried out in a simple manner.

In another aspect of the invention, there is provided an air conditioner comprising: an outdoor unit having at least one compressor, at least one heat exchanger, at least one expansion device, and tube connectors; at least one room unit having a heat exchanger and tube connectors; and refrigerant tubes for connecting the room unit with the outdoor unit to form a refrigerant circuit, wherein the outdoor unit is adapted to be connected to the at least one room unit via a connection box having means for disabling the expansion device; a multiplicity of branching refrigerant tubes having a multiplicity of branches each equipped with a valve and a expansion device, and adapted to branch the refrigerant into the at least one room unit connected thereto; and a casing accommodating the branching refrigerant tubes, the connection box mountable on an exterior wall of the outdoor unit.

It could be understood that this air conditioner does not require in the refrigerant in the outdoor unit built-in branching tubes for connecting a multiplicity of room units, since the air conditioner is provided with an additional connection box which includes branching refrigerant tubes. Since the connection box is adapted to be mounted on an external wall of the outdoor unit, the outdoor unit itself can be made compact. The multiple room units may be connected securely and safely to the outdoor unit by simply mounting the connection box on the outdoor unit, connecting the refrigerant tubes of the outdoor unit to the connectors of the branching tubes of the connection box, and then connecting the room units to the connectors of the connection box. Since the piping work does not require removing, disconnecting, or re-connecting inner tubes of the units, improper piping is not likely to occur. In addition, this air conditioner has an advantage over the first one that no connection box is required in connecting a single room unit.

These and other features of the present invention may be more readily understood by reference to the following description, taken in conjunction with the accompanying drawings. Details of the invention has been also disclosed in Japanese Patent Applications Nos. 8-112168 and 8-112172 filed on Apr. 10, 1996. The entire disclosure of the Japanese Patent Application including specification, claims, drawings and summary are incorporated herein by reference in its entirety.

DETAILED DESCRIPTION OF THE PREFERRED EMBODIMENT

Figure 1:
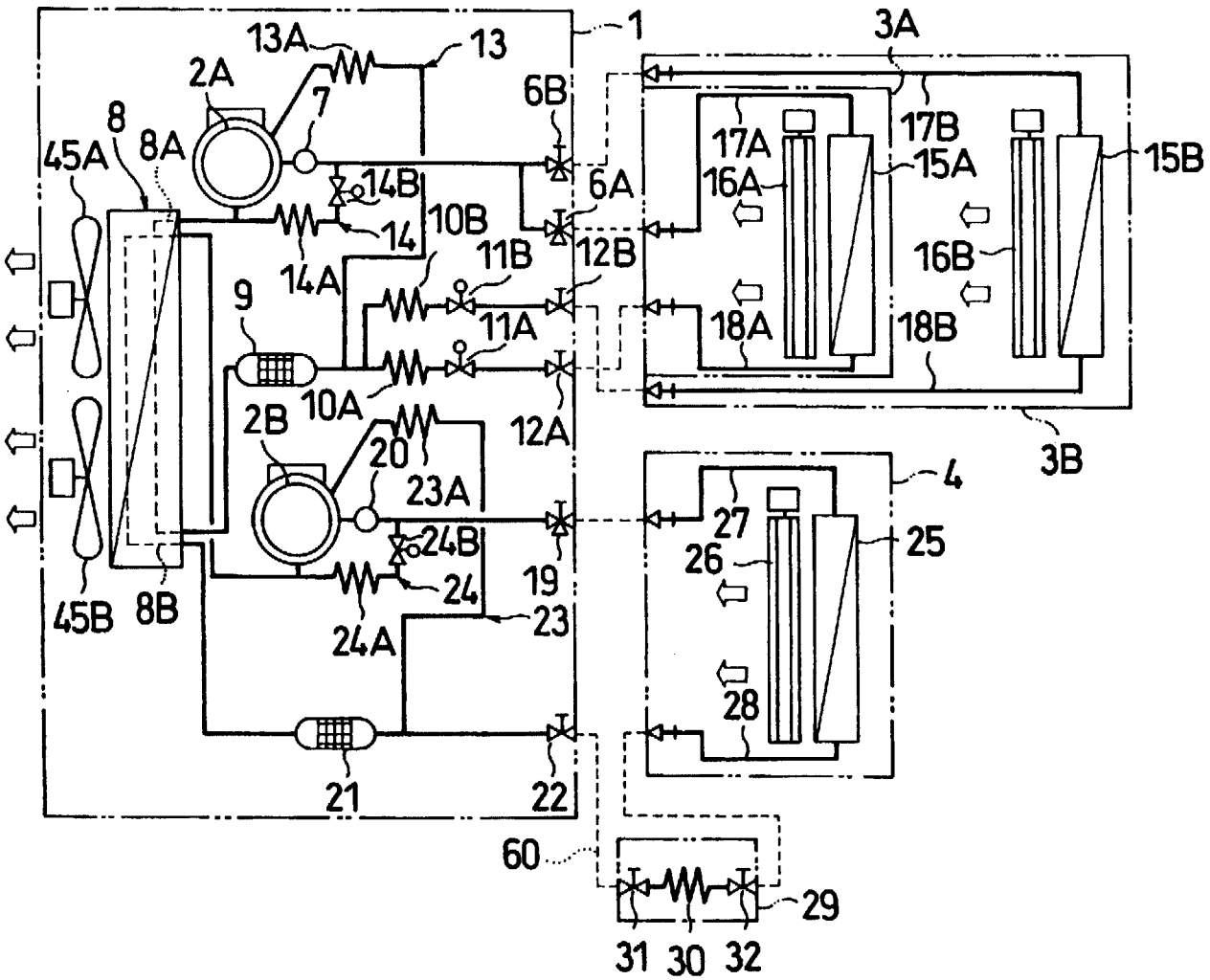
FIG. 1 is a schematic view of a refrigerant circuit of the air conditioner according to the invention in which an outdoor unit is connected to two small room units along with a large room unit.
Figure 2:
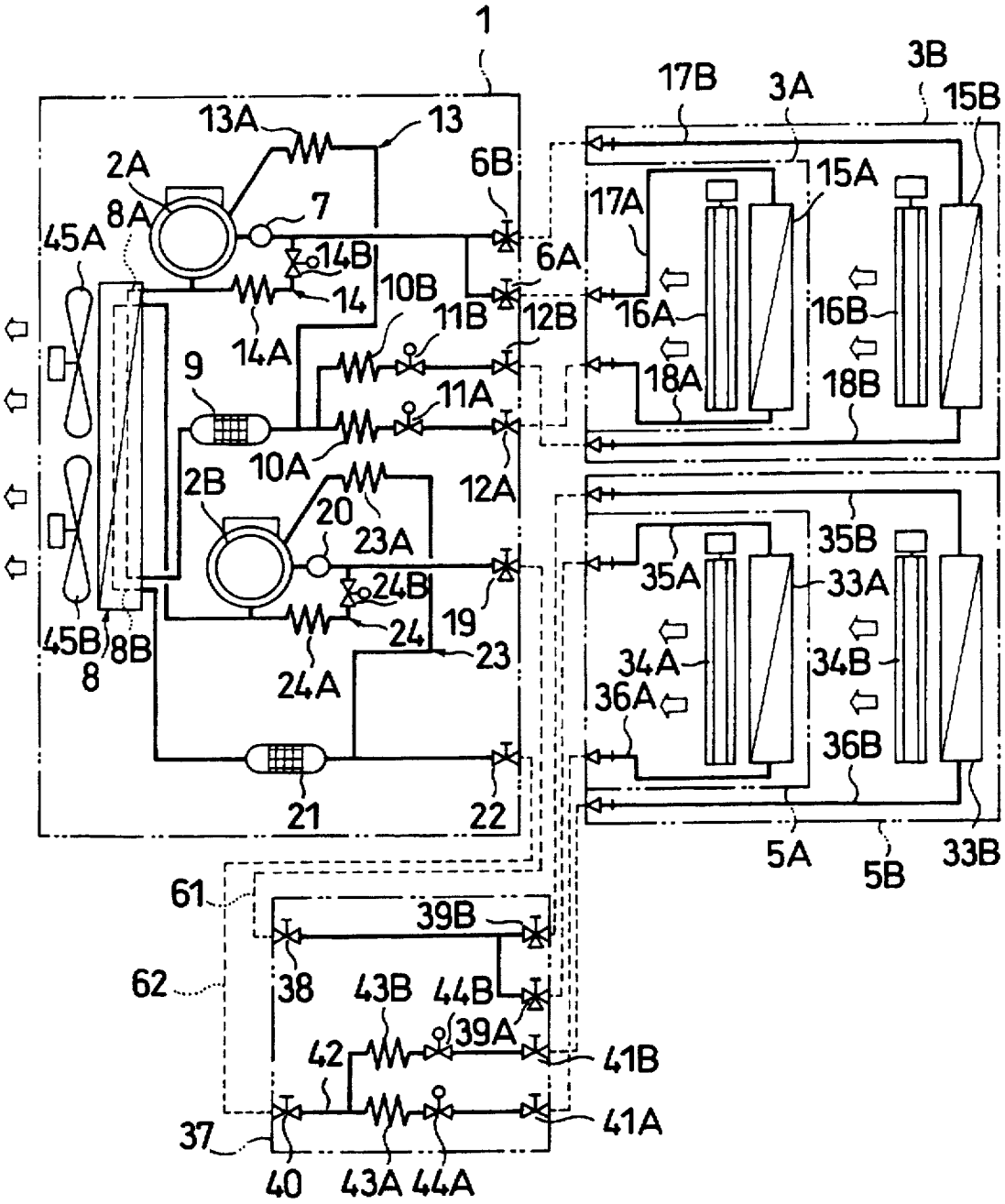
FIG. 2 is a schematic view of a refrigerant circuit of the air conditioner according to the invention in which an outdoor unit is connected to two sets of two small room units.

Referring now to FIGS. 1 and 2, there are shown refrigerant circuits for use in an air conditioner according to the invention. FIG. 1 illustrates an example in which an outdoor unit 1 includes two compressors 2A and 2B having different nominal powers such that the small compressor 2A (having for example a nominal power of 1.5 kW) is connected to two small room units 3A and 3B (each having for example a refrigeration capacity of 2.3 kW) while a larger compressor 2B (having for example a nominal power of 1.7 kW) is connected to a large room unit 4 (having for example a refrigeration capacity of 5.2 kW) or, as shown in FIG. 2, connected to two small room units 5A and 5B (each having for example a refrigeration capacity of 2.6 kW).

Included in the outdoor unit 1, and connected in series in the order mentioned, are: two connection valves 6A and 6B; an accumulator 7; the compressor 2A; a heat transfer tube 8A of a heat exchanger 8; a strainer 9; capillary tubes 10A and 10B; electromagnetic valves 11A and 11B; and connection valves 12A and 12B. This circuit will constitute a first main refrigeration circuit when it is connected with two room units 3A and 3B. The first refrigeration circuit also includes an injection circuit 13 which comprises a capillary tube 13A having a large contraction and serves as a feedback loop for feeding part of the refrigerant back to the compressor 2A to cool the compressor 2A, and a by-pass circuit 14 comprising a capillary tube 14A and an electromagnetic valve 14B for by-passing part of the refrigerant to reduce the flow rate of the refrigerant in the compressor 2A while operating only one of the room units 3A and 3B.

The room units 3A and 3B have such components as heat exchangers 15A and 15b, respectively, and fans 16A and 16B, respectively. By connecting refrigerant tubes 17A and 17B of the room units 3A and 3B to the connection valves 6A and 6B, respectively, and connecting tubes 18A and 18B of the room units to the connection valves 12A and 12B of the outdoor unit 1, a complete refrigeration circuit is established, including the accumulator 7, compressor 2A, a heat transfer tube 8A of the heat exchanger 8, strainer 9, capillary tubes 10A and 10B, electromagnetic valves 11A and 11B, and a heat exchanger 15A

In this refrigerant circuit, when the two room unites 3A and 3B are in operation, cold refrigerant supplied from the outdoor unit 1 to the heat exchangers 15A and 15B of the room units 3A and 3B absorbs heat from the ambient air which is circulated by the fans 16A and 16B, thereby cooling the air in the room, while the refrigerant which acquired heat in the room is returned to the outdoor unit 1 through the refrigerant tube 17A and 17B and through the connection valves 6A and 6B. The refrigerant is further delivered to the accumulator 7, where the refrigerant in the gaseous phase is separated from the liquid refrigerant and supplied to the compressor 2A.

The gaseous refrigerant supplied to the compressor 2A is sent to the heat exchanger 8, where the refrigerant is cooled and gets liquefied. The liquefied refrigerant is passed through the strainer 9 so that foreign objects are removed from the refrigerant. As the refrigerant is contracted or decompressed in the capillary tubes 10A and 10B, it becomes cold liquid refrigerant. The cold refrigerant is then supplied to the; heat exchangers 15A and 15B via electromagnetic valves 11A and 11B, the connection valves 12A and 12B, and refrigerant tubes 18A and 18B. The refrigerant is evaporated in the heat exchangers 15A and 15B and gets cooled further. The cooled vapor in turn cools the air in the heat exchangers 15A and 15B which is fanned out into the room.

In order to prevent overheating of the compressor 2A caused by the operation of the two room units 3A and 3B, part of the refrigerant is diverted from the refrigerant tube, at a point where the tube branches to the capillary tubes 10A and 10B, to the compressor 2A via the injection circuit 13. When one of the two room units 3A and 3B is temporarily inactive or when the room temperature is below the preset temperature, a corresponding one of the electromagnetic valves 11A and 11B is closed, and to prevent excessive supply of refrigerant to the room unit in operation, part of the refrigerant coming out of the compressor 2A is fed back to the accumulator 7 via a by-pass circuit 14

On the other hand, a refrigerant line that starts from a connection valve 19 and goes through an accumulator 20, the compressor 2B, a heat transfer tube 8B of the heat exchanger 8, a strainer 21, and a connection valve 22 will constitute a second main refrigerant circuit (for use in refrigeration cycle) when the line is connected to the room unit 4 or the two room units 5A and 5B. The line is also provided with an injection circuit 23 for feeding back part of the refrigerant to the compressor 2B and a by-pass circuit 24 for by-passing part of the refrigerant to prevent excessively supply of refrigerant that might happen during operation of the small room units. The injection circuit 23 is equipped with a capillary tube 23A having a strong contraction, while the by-pass circuit is equipped with a capillary tube 24A and an electromagnetic valve 24B.

The room unit 4 is provided with such components as a connection tube 28, a heat exchanger 25, a fan 26, and a connection tube 27. In connecting the room unit 4 with the outdoor unit 1, the connection tube 27 is directly connected to the valve 19, while the connection tube 28 is connected indirectly via a first connection box 29.

The first connection box 29 has a capillary tube 30 accommodated in a box and having its opposite ends connected to connection valves 31 and 32 which are mounted on the connection box 29.

On the other hand, the two room units 5A and 5B, like the room units 3A and 3B, have heat exchanger 33A and 33B, respectively, and fans 34A and 34B, respectively. These room units are connected to the compressor 2B of the outdoor unit 1 by connecting tubes 35A, 35B, 36A, 36B with a second connection box 37, as shown in FIG. 2

The second connection box 37 has a box that houses connection valves 38, 39A, 39B, 40, 41A, and 41B mounted on the box and two branching tubes. One of the branching tube connects the connection valves 38 with the connection valves 39A and 39B. Another branching tube 42 having capillary tubes 43A and 43B and electromagnetic valves 44A and 44B connects the connection valve 40 with the connection valves 41A and 41B.

In the heat exchanger 8 of the outdoor unit 1, fans 45A and 45B and fins (not shown) are designed to be shared by two tubes 8A and 8B.

Figure 3:
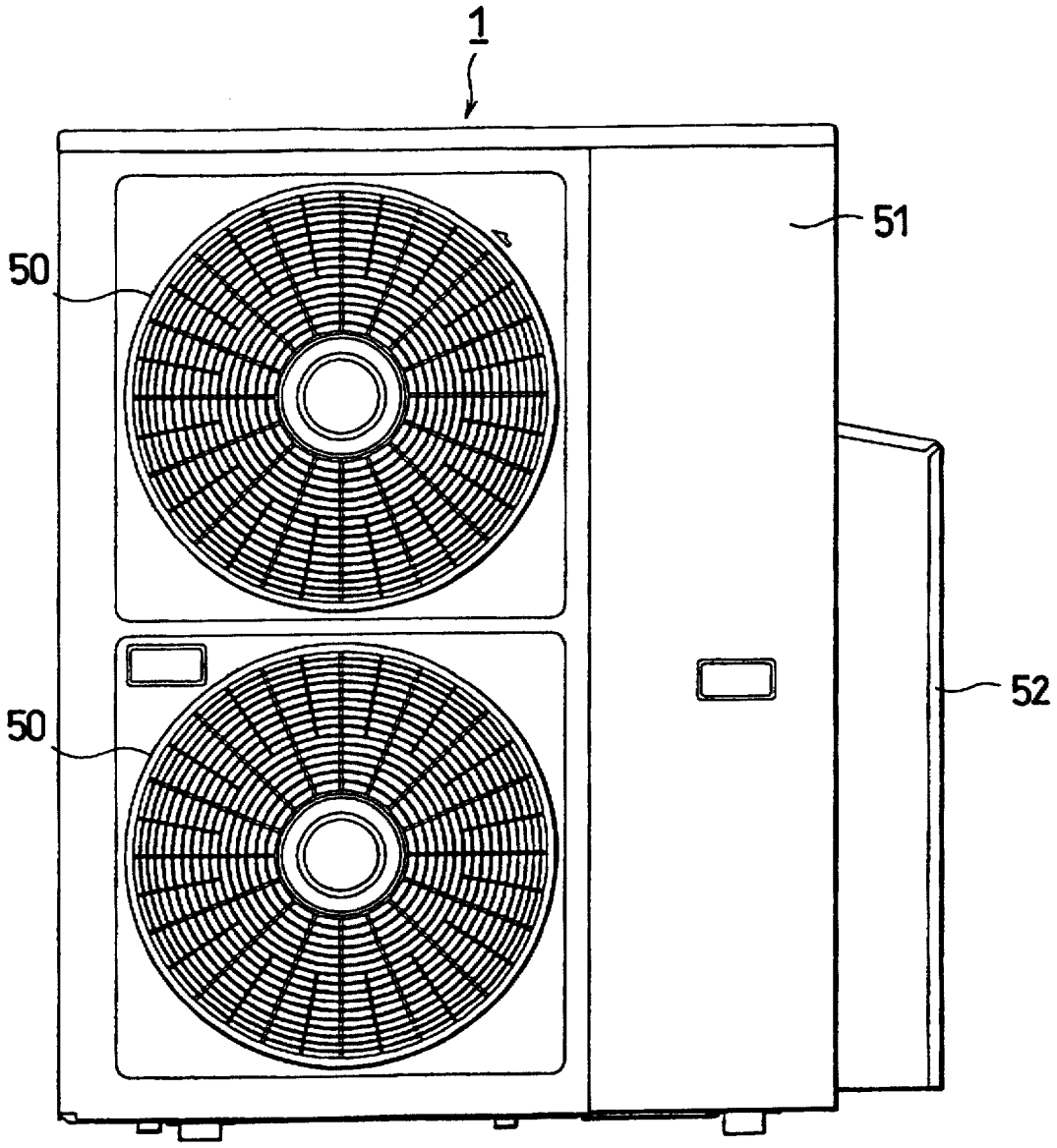
FIG. 3 is a front view of the outdoor unit of the air conditioner of the invention.

FIG. 3 shows a front view of the outdoor unit 1. As seen in the figure, there is provide on the front face of the casing of the unit 1 is a fan gird 50 for protecting the two fans 45A and 45B. A machinery room 51 is provided adjacent the fan gird 50. Next to the machinery room 51 is an outdoor connection box 52 for connecting thereto tubes from the room units.

Figure 4:
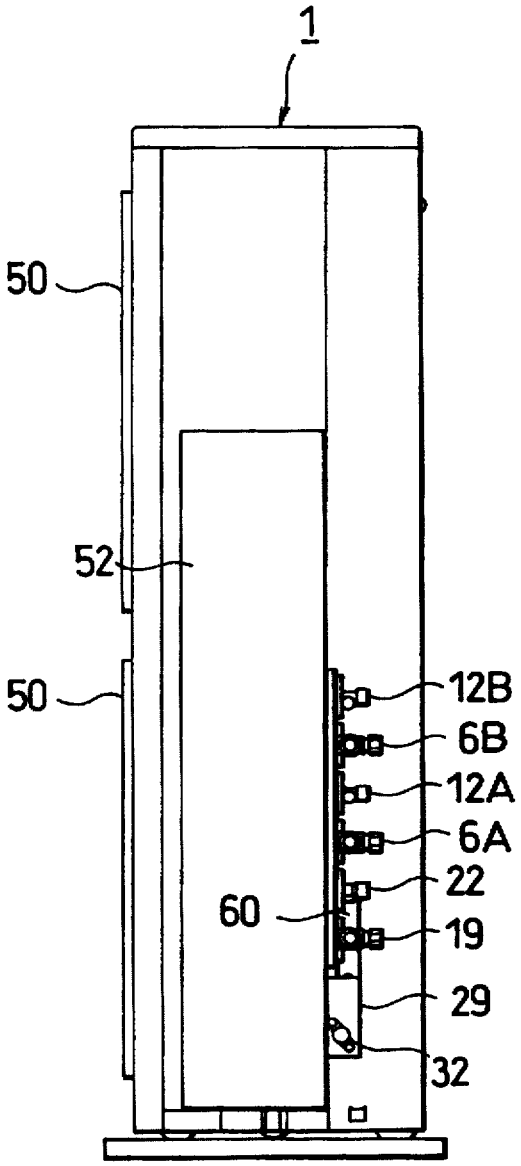
FIG. 4 is a side view of the outdoor unit for use with the air conditioner of FIG. 1.
Figure 5:
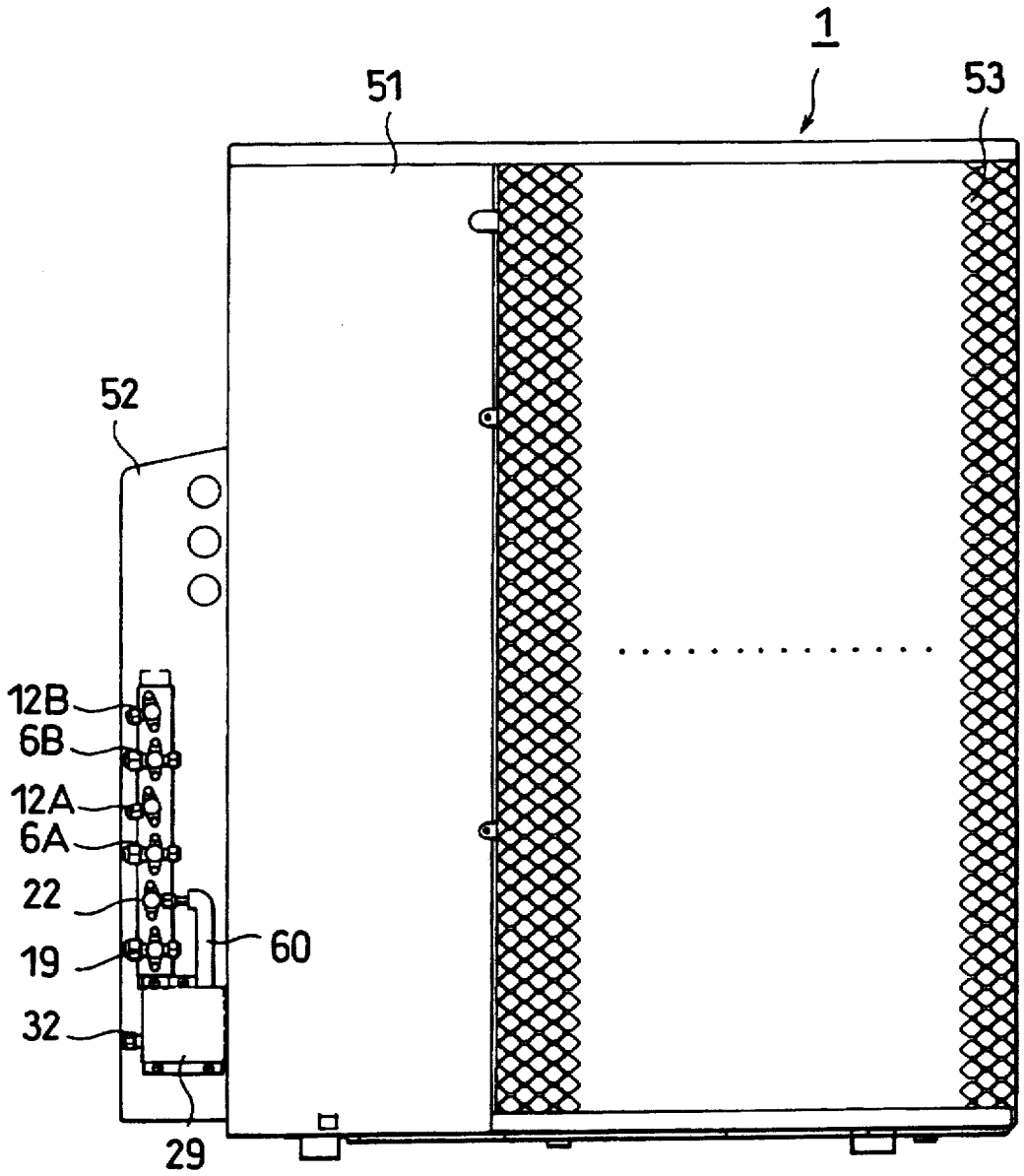
FIG. 5 is a rear view of the outdoor unit of FIG. 4.

FIG. 4 is a side view of the outdoor unit 1, showing connectors that may connect thereto connectors of a single room unit 4. FIG. 5 is a rear view of the outdoor unit 1, showing that connection valves of the outdoor unit 1 are mounted on a panel on the back of the outdoor connection box 52 and that the connection box 29 is mounted on the connection box 52 and beneath the panel.

When the outdoor unit 1 is connected to a single, room unit 4, the connection tube 27 is connected to the connection valve 19 of the outdoor unit 1, the connection valve 31 of the connection box 29 is connected to the connection valve 22 of the outdoor unit 1 by a connection tube 60, the connection tube 28 is connected to the connection valve 32 on the connection box 29, thereby establishing a refrigerant circuit that goes through the accumulator 20, the compressor 2B, the heat transfer tube 8B of the heat exchanger 8, the strainer 21, the connection box 29, and the heat exchanger 25.

In this refrigerant circuit, the refrigerant supplied from the outdoor unit 1 to the heat exchanger 25 undergoes heat transfer with the air which is blown through the heat exchanger 25 by the fan 26. The refrigerant is then taken into the outdoor unit 1 via the connection tube 27 and connection valve 19, and further into the accumulator 20, where the gaseous refrigerant is separated from the liquid phase refrigerant and is passed to the compressor 2B.

The gaseous refrigerant is compressed in the compressor 2B and sent to the heat exchanger 8 so that the refrigerant is cooled by the ambient air and condensed back to liquid. The liquefied refrigerant is passed through the strainer 21 to remove foreign objects in the refrigerant, and supplied to the capillary tube 30 in the connection box 29 through the connection valve 22 The refrigerant is decompressed as it passes through the capillary tube 30, loosing its static pressure. The low pressure liquid refrigerant exiting the connection valve 32 is supplied to the heat exchanger 25 through the connection tube 28, where it evaporates, refrigerating the heat exchanger 25. The air cooled by the heat exchanger 25 is fanned out of the heat exchanger 25 into the room, thereby air-conditioning the room.

Figure 6:
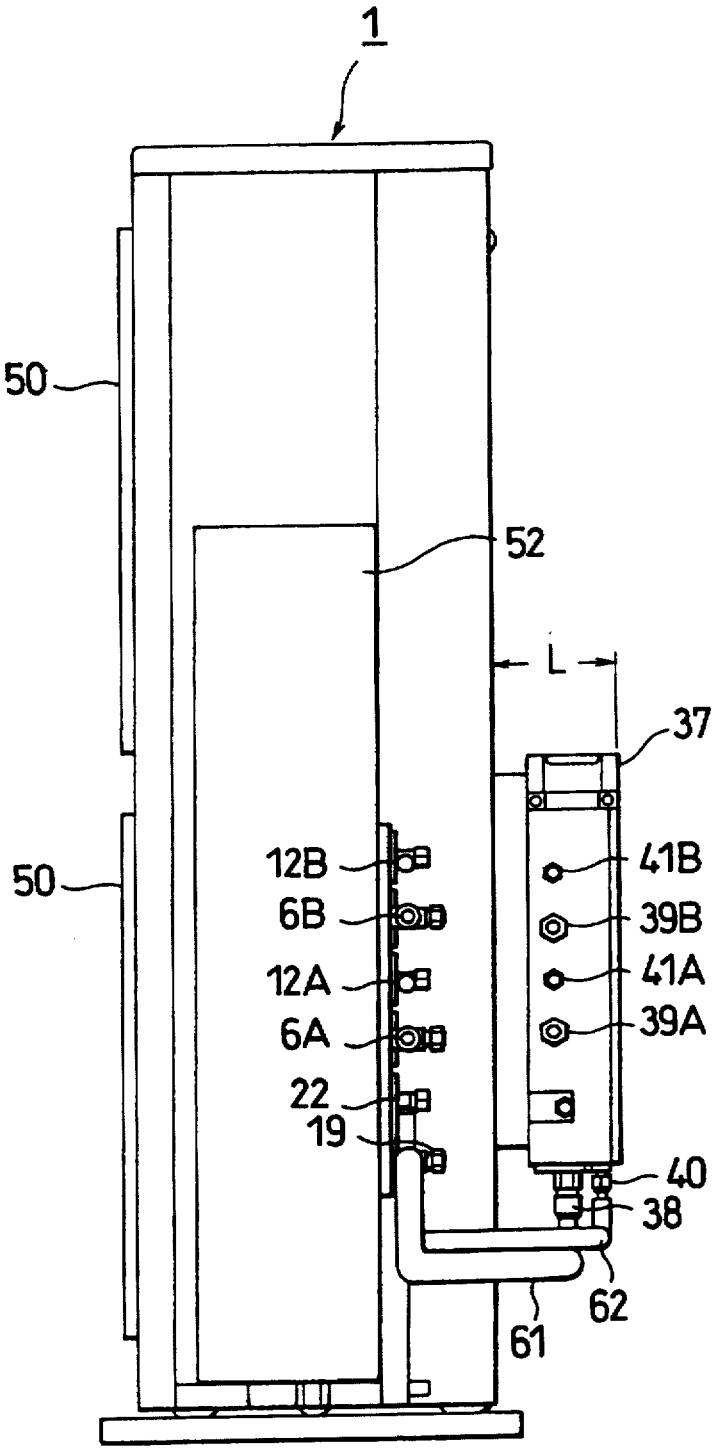
FIG. 6 is a side view of the outdoor unit for use in the air conditioner of FIG. 2.
Figure 7:
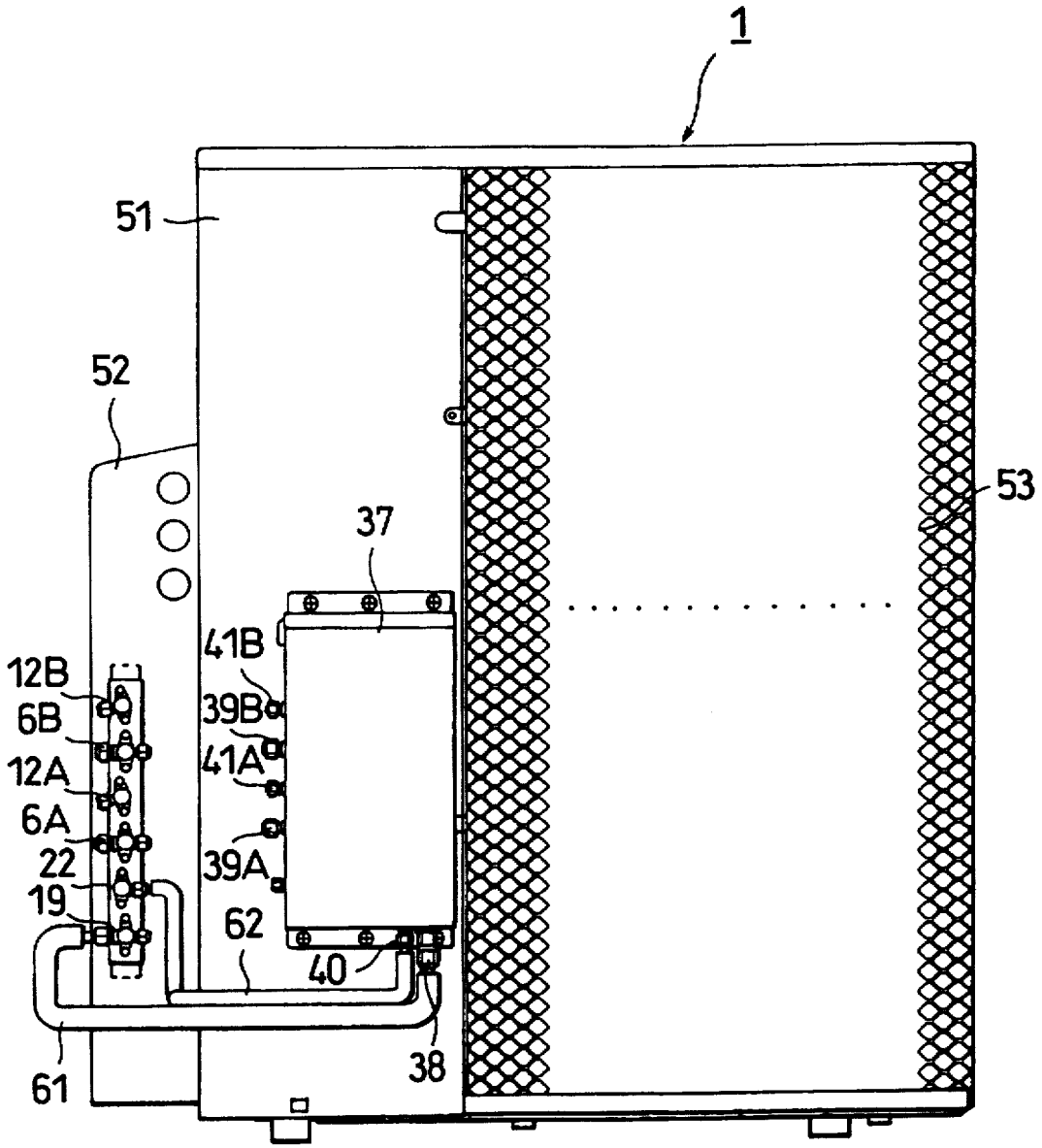
FIG. 7 is a rear view of the outdoor unit of FIG. 6.

On the other hand, when the compressor 2B of the outdoor unit 1 is connected to the two room units 5A and 5B, the connection box 37 is mounted on the back of the machinery room 51 instead of the connection box connection box 29, as shown in FIG. 6 and FIG. 7. By connecting the valve 19 of the outdoor unit 1 with the connection valves 38 on the connection box 37, and the connection valve 22 with the connection valve 40 by refrigerant tubes 61 and 62, respectively, and the connecting the tubes 35A, 35B, 36A, and 36B of the room units 5A and 5B with the connection valves 39A, 39B, 41A, 41B on the connection box 37, a refrigerant circuit is constructed that goes through the accumulator 20, the compressor 2B, tube heat transfer tube 8B of the heat exchanger 8, the strainer 21, capillary tubes 43A and 43B, electromagnetic valves 44A and 44B, and the heat exchangers 33A and 33B. This refrigerant circuit permits operation of the two room units 5A and 5B for the air-conditioning of the room, as in the air-conditioning by the two units 3A and 3B as described above.

In this manner, a large room unit may be operated in parallel with two small room units 3A and 3B connected to compressor 2A of the outdoor unit 1 if it is connected to the outdoor unit 1 via the connection box 29 mounted on the outdoor unit 1. Likewise, two room units 5A and 5B having intermediate power may be conveniently and correctly connected to outdoor unit 1 via the connectors of the connection box 37 so that they can be operated safely in parallel with other room units.

If the outdoor unit i is delivered to a user with a connection box 29 mounted on the outdoor unit 1, and if a single room unit 4 is to be connected to the compressor 2B, he may connect the unit 4 on site by simply connecting the tube 27 with the connection valve 19, and tube 28 with the connection valve 32. If instead two room units 5A and 5B are replaced by a connection box 37 on site and connecting the connection valves 38 to the connection valve 19 and the connection valve 22 to the connection valve 40 by the refrigerant tubes 61 and 62, and further connecting the tubes 35A and 35B to the connection valves 39A and 39B, 36A and 36B to the, connection valves 41A and 41B. It should be appreciated that in assembling these components, manipulation of the tubes which are already installed inside the units is not required, so that assembly of the air-conditioner is simple and reliable.

It would be noted that the connection box 37 is mounted on, but away from, the back of the outdoor unit 1 at a distance L such that the air blown out of the heat exchanger 8 can escape free into a space between the back of the outdoor unit 1 and the wall of the room. That is, the connection box 37 serves as a spacer to maintain appropriate clearance for an air intake 53 of the outdoor unit 1, so that enough air is secured for the heat exchanger 8. This facilitates efficient heat transfer by the heat exchanger 8.

Figure 8:
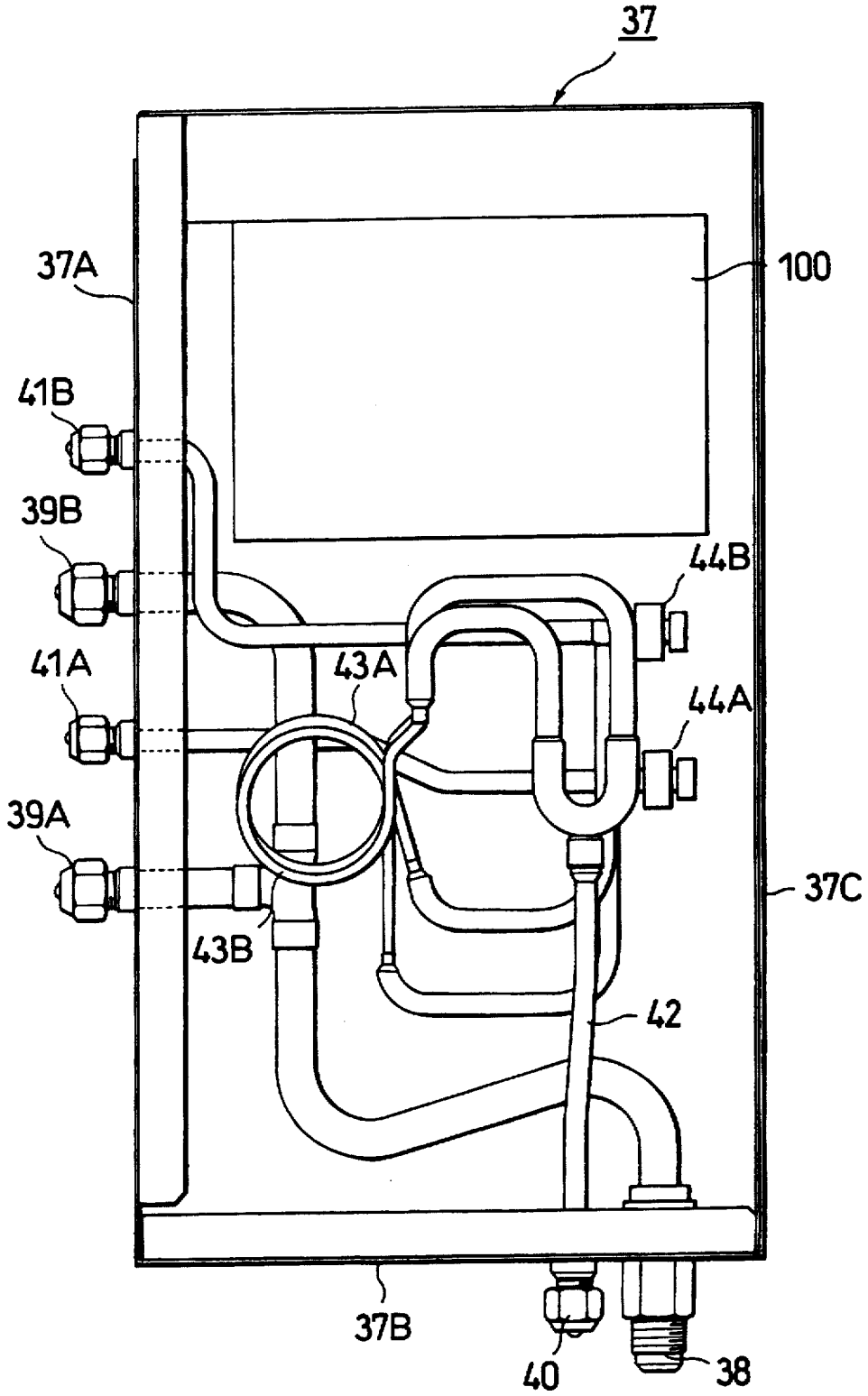
FIG. 8 is a schematic view of refrigerant tubes and an electric circuit box arranged in a second connection box according to the invention.

FIG. 8 shows an arrangement of various tubes and an electric circuit box 100 in the connection box 37. The connection box 37 shown in this example includes a thin book shape configuration for accommodating branching tubes and a box 100 (referred to as electric circuit box) containing a set of electric circuits (referred to as branch kit) for controlling various signals as described later in connection with FIGS. 12 and 13. The connection box 37 has a left side 37A facing the outdoor connection box 52. Mounted on this side 37A are the connection valves 39A, 39B, 41A, and 41B to be connected to the tubes 35A and 35B, 36A, 36B, respectively, of the room units 5A and 5B, respectively. Mounted on a lower side 37B adjacent the 37A are the connection valves 38 and 40.

It would be understood that the branching tubes or branching tubes required for the room units are not installed in the outdoor unit 1, but instead installed in the separate connection box 37 on the exterior of the outdoor unit 1, so that the entire dimensions of the outdoor unit 1 is greatly reduced. It should be appreciated that the connection valves 38 is disposed on the lower side of the connection box 37, instead of the left side thereof, to decrease the vertical dimension of the connection box 37. This is due to the fact that the branching tube 42 cannot be easily bent if it is very short, so that it is difficult to mount in a compact shape the connection valves 38 on the left side 37A. It should be also noted that in order to easily identify various connectors mounted on the connection box 37, connectors for the room units 5A and 5B are mounted on the left side, while those connectors to be connected to the outdoor unit 1 are positioned at the lower side of the connection box 37.

The branching tube 42 between the connection valves 38 and the connection valves 39A and 39B has a large diameter so that it is difficult to bend it on site. Therefore, in manufacturing the connection box 37, the lower side 37B is provided with a cut at one end thereof facing the right side 37C to receive therein the branching tube 42. The tube 42 is inserted from the right into the connection box 37 together with the connection valves 39A and 39B until the valve 39A and 39B are properly set on the left side 37A and the valve 38 at the end of the cut in the lower side 37C. The cut can be made as shallow as possible by positioning the valve 38 close to the right side 37C so that the entire tube 42 may be easily mounted in the connection box 37.

Accommodated in the connection box 37 is an electric circuit box 100 which includes therein a branch box for controlling the electromagnetic valves 44A and 44B.

In the preceding description the room unit 4 is connected to the compressor 2B of the outdoor unit 1 via the connection box 29 mounted on the outdoor unit 1. However, the room unit 4 may be connected to the outdoor unit 1 equally well without the connection box 29, as shown in FIG. 9 and described below.

Figure 9:
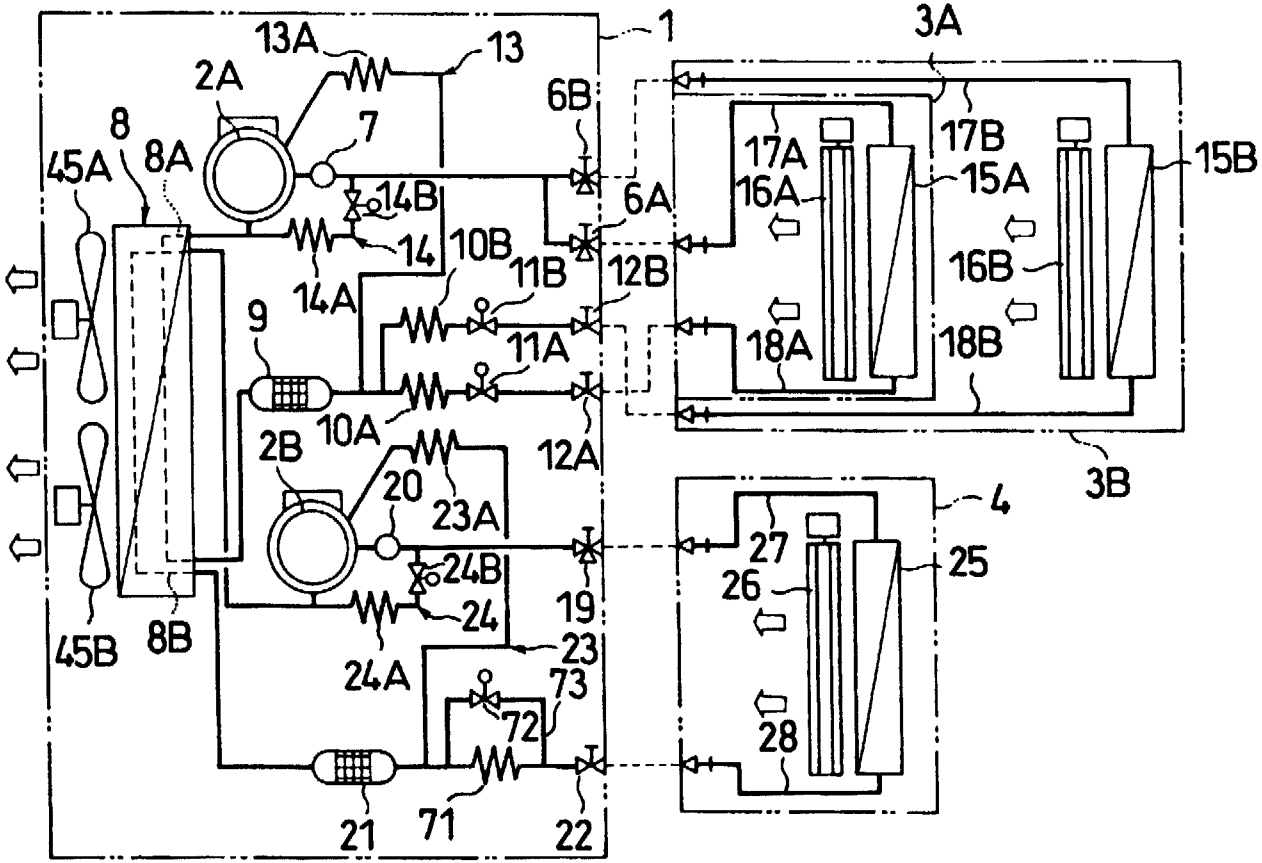
FIG. 9 is a schematic view of another refrigerant circuit of the air conditioner according to the invention in which an outdoor unit is connected to two small room units along with a large room unit.

In FIG. 9 those components corresponding to the same or like components shown in FIG. 1 are denoted by the same reference numbers. In addition to the arrangement shown in FIG. 1, the arrangement of FIG. 9 is provided, between the strainer 21 of the outdoor unit 1 and the connection valve 22, with a capillary tube 71 which serves as a expansion device and with a by-pass 73 which consists of an electromagnetic valve 72 for by-passing the capillary tube 71 as it is needed.

With this arrangement, if a single room unit 4 is connected to the outdoor unit 1 by connecting the connection tube 27 and 28 of the room unit 4 to the connection valves 19 and 22 of the outdoor unit 1, respectively, and closing the electromagnetic valve 72 as shown in FIG. 9, the resulting refrigerant circuit (for refrigeration cycle) is the same as the circuit of FIG. 1 obtained by the use of the connection box 29.

Figure 10:
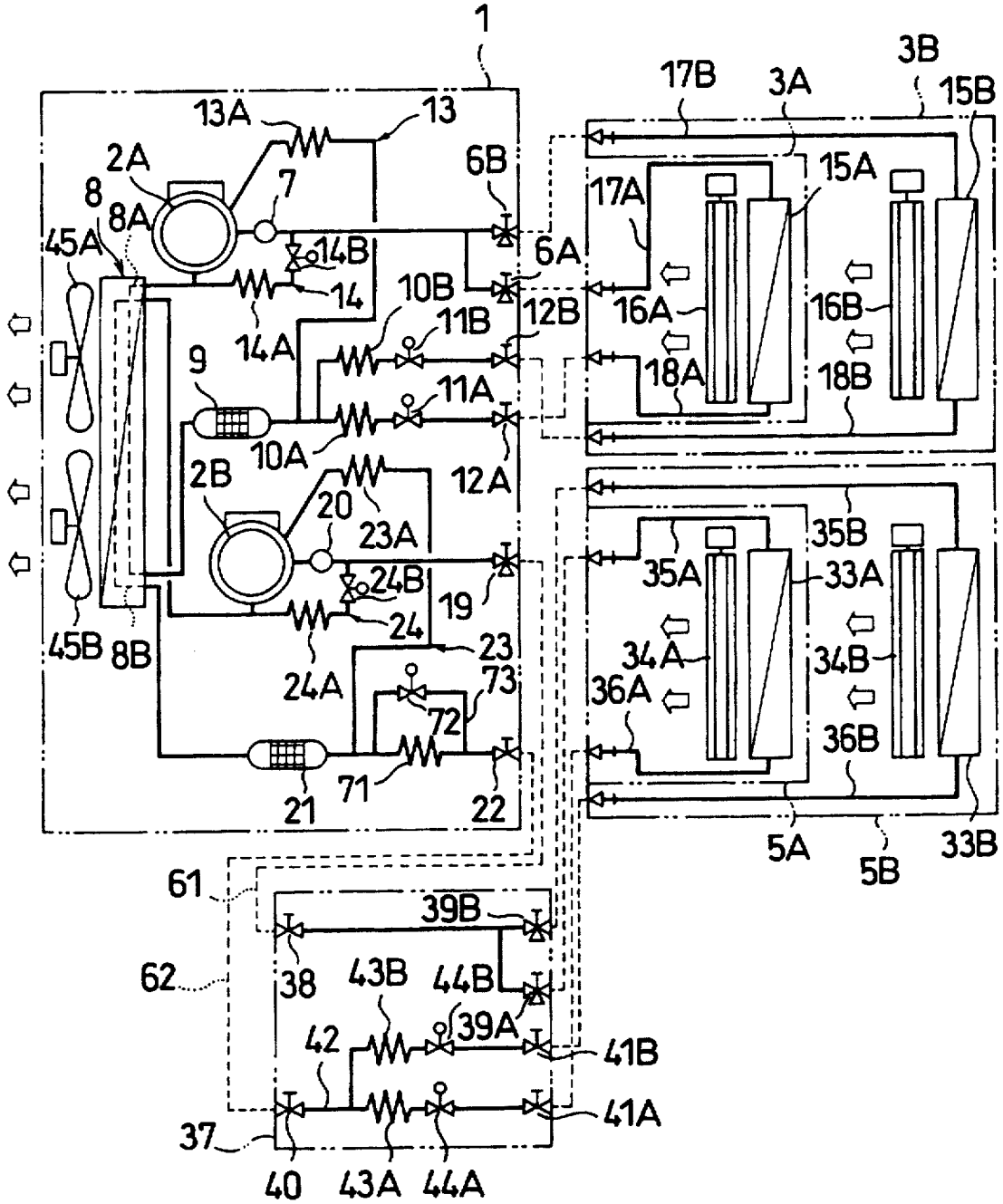
FIG. 10 is a schematic view of another refrigerant circuit of the air conditioner according to the invention in which an outdoor unit is connected to two sets of two small room units.

If, instead, two room units 5A and 5B must be connected to the outdoor unit 1, then the connection box 37 is mounted in position on the exterior wall of the outdoor unit 1 and the room units are connected to the connection box 37 as shown in FIG. 10. With the electromagnetic valve 72 opened, the resulting refrigerant circuit is the same as the one shown in FIG. 2 for a refrigeration circuit obtained by the room units 5A and 5B.

Figure 11:
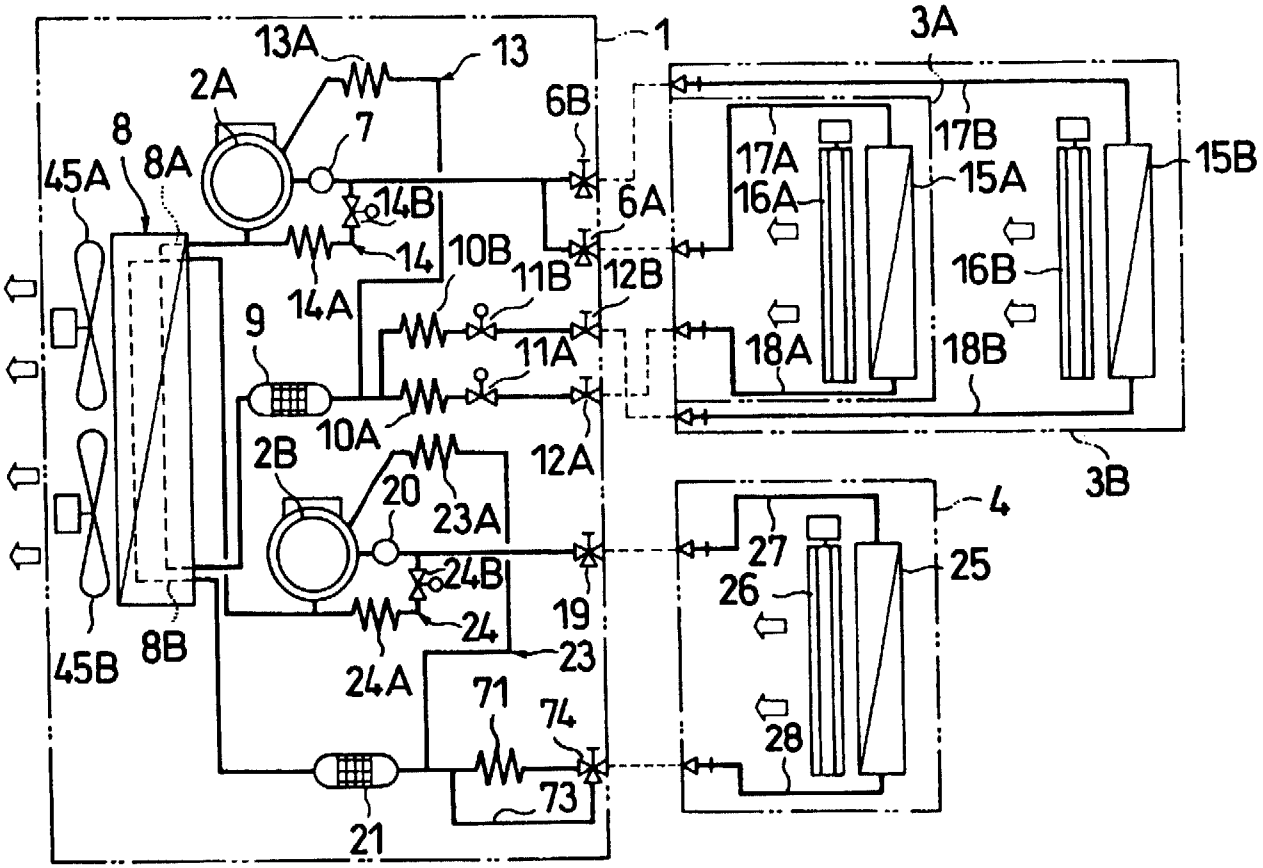
FIG. 11 is a schematic view of still another refrigerant circuit of the air conditioner according to the invention in which art outdoor unit is connected to two small room units along with a large room unit.

FIG. 11 illustrates an alternative arrangement of the refrigerant circuit, in which the by-pass 73 is a simple tube but the capillary tube 71 and the by-pass 73 are connected together at their outlet ends with a three-way valve 74 so that either one of the capillary tube 71 and the by-pass tube 73 may be selected depending on whether one or two of the room units is/are connected. In either selection, an optimum efficiency may be established equally well as in the preceding alternative example.

Figure 12:
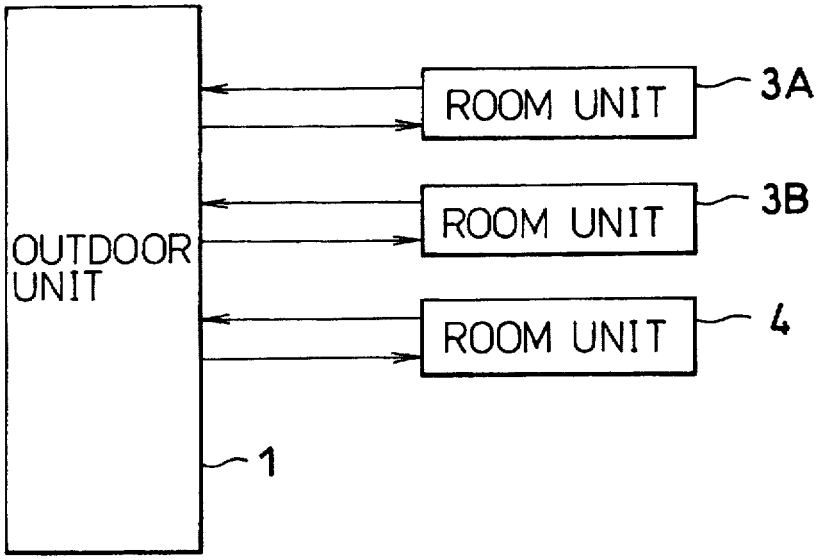
FIG. 12 is a schematic view of an electric circuit of air conditioner of the invention in which an outdoor unit is connected to two small room units along with a large room unit.
Figure 13:
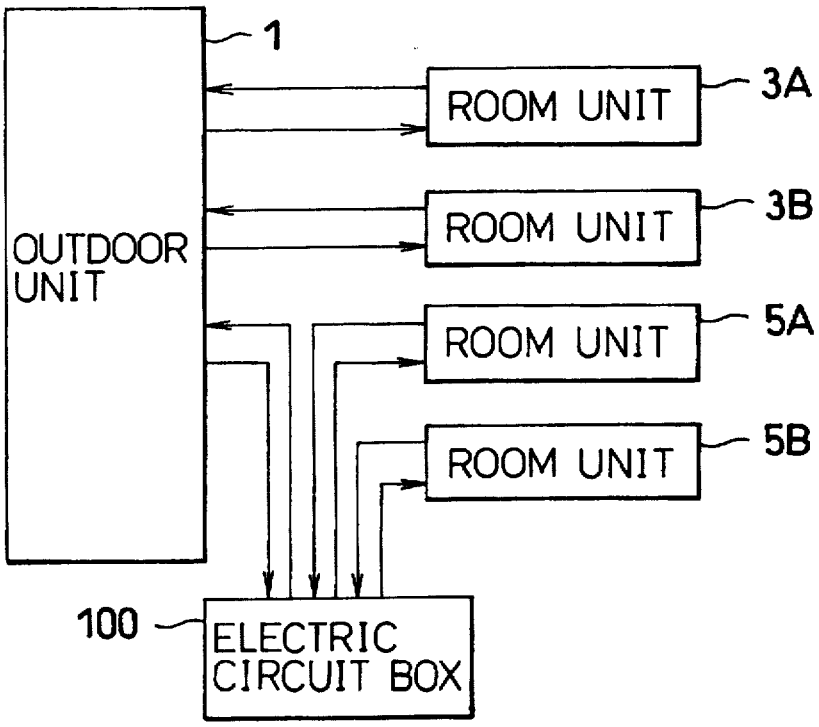
FIG. 13 is a schematic view of an electric circuit of air conditioner of the invention in which an outdoor unit is connected to two sets of two small room units.

FIG. 12 is a block diagram showing electric connections when a single room unit 4 is connected to the compressor 2B of the outdoor unit 1. FIG. 13 is a block diagram showing electric connections when two room units 5A and 5B are connected to the compressor 2B. As shown in these figures, when only one room unit 4 is connected to the compressor 2B, the room unit is electrically connected with the compressor 2B directly, but when two room units 5A and 5B are connected to the compressor 2B, they are electrically connected via the electric circuit box 100.

Figure 14:
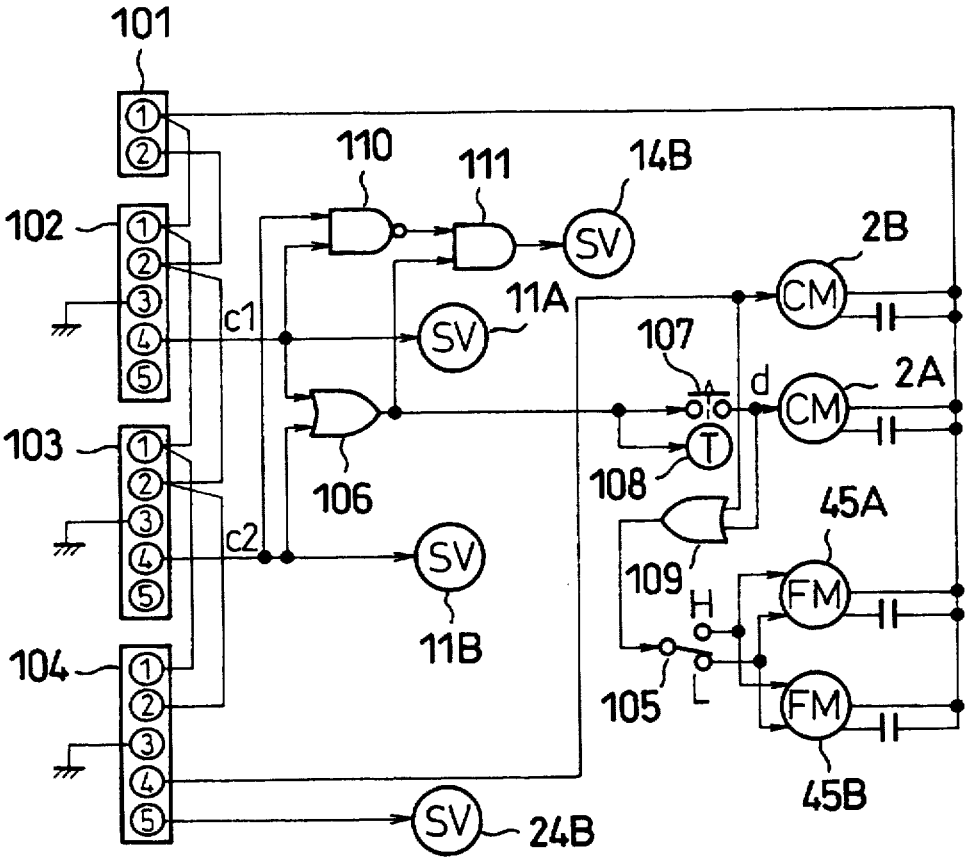
FIG. 14 is an electric circuit diagram of an outdoor unit of an air conditioner according to the invention.

FIG. 14 shows an electric circuit of the outdoor unit 1. A connector 101 is supplied with 220–240 Volt single phase ac power. Connectors 102 through 104 are connected to respective signal lines from the room units 3A, 3B, and 4. Terminals numbered 1 of respective connectors are connected with each other, and so are the terminals numbered 2. Hence, the single phase ac power supplied to the terminal 1 of the connector 101 is supplied to the respective room units 3A, 3B, and 4 from the corresponding connectors 102 through 104.

The compressors 2A and 2B shown in this example have refrigeration capacity of 1.5 kW and 1.7 kW, respectively. They are each energized by single phase induction motors connected to the power source via respective electric capacitors.

Two electric fans 45A and 45B installed in front of the heat exchanger 8 are also energized by respective single phase ac induction motors which are connected to the power source via respective electric capacitors. In order to control the flow rate of air to the heat exchanger 8, each of the electric motors of the fans has a tap for switching between a high speed (H) and a low speed (L) rotations.

A temperature switch 105 is provided to switch between the two levels H and L in response to the difference between a preset temperature and the ambient temperature. When the ambient temperature is high, the fans 45A and 45B are switched to H for faster rotation.

An electromagnetic valves 11A is actuated to open allowing the refrigerant to pass therethrough when the connector 102 receives at its terminal 4 signal H (indicative of operation of a room unit) from the room unit 3A. Similarly, an electromagnetic valve 11B is opened when it receives signal H from the room unit 3B at its terminal 4. In this manner a relevant refrigerant passage is opened upon reception of the H signal from a room unit.

An OR gate 106 goes high, generating signal H, when at least one of the connector 102 and the connector 103 receives signal H at its terminal 4. The signal H from the OR gate 106 closes a timer relay switch 107, which are normally opened to disable the compressor 2A, but when closed activates the compressor. Specifically, the signal H activates the compressor 2A via a power relay circuit. However, since such power relay is well known in the art, further description thereof will not be presented here for simplicity of description of the invention.

Opening/closing of the timer relay switch 107 is controlled by a timer relay 108. The timer relay 108 causes the 107 to open when the timer relay 108 is not energized, that is, when the level of the switching OR gate is low (L). When the switching OR gate goes high, supplying power to the timer relay 108, the timer relay continues to keep the timer relay switch 107 open for a predetermined period of time T1 (which is set to prevent the compressor 2A from restarting, and ranges from 2 to 3 minutes). Only after this period, the timer relay switch 107 is closed by the timer relay and kept closed so long as the power is supplied to the timer relay.

When at least one of the compressors 2A and 2B is active (or operating), an OR gate 109 goes high, generating signal H, which is supplied to the temperature switch 105. Thus, when the compressor 2A and/or the compressor 2B is in operation, the fans 45A and 45B are activated, thereby blowing air to the heat exchanger 8.

A NAND gate 110 and an AND gate 111 are provided in the circuit to control the electric current through the electromagnetic valve 14B based on the logical state of the OR gate 106. This electromagnetic valve 14B is provided to actuate an unloader for the compressor 2A. The electromagnetic valve 14B is opened when only one of the two input signals received by the OR gate 106 is high. Thus, the electromagnetic valve 14B serves as a loader. That is, the valve 14B serves to control the refrigeration capacity of the compressor 2A in accordance with the load imposed on the compressor 2A.

The H signal received by the connector 104 at its terminal 4 is passed to the compressor 2B to control the operation thereof.

An electromagnetic valve 24B, which is provided to control the unloader of the compressor 2B, is actuated by the H signal received from the terminal 5 of the connector 104.

Figure 15:
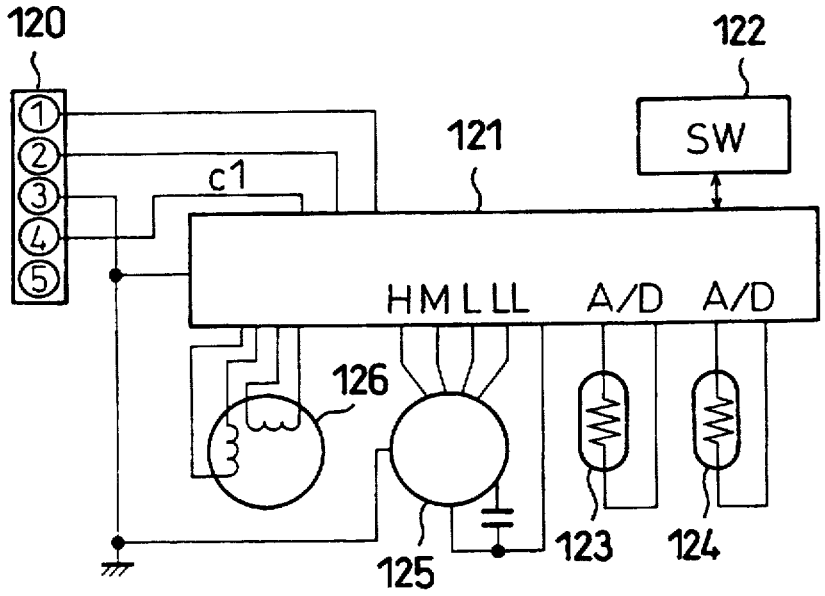
FIG. 15 is another electric circuit diagram of a room unit of an air conditioner according to the invention.

Referring now to FIG. 15, there is shown an electric circuit of a room unit such as the room unit 3A. A connector 120 has a number of terminals to be connected with the corresponding terminals of the outdoor unit.

A controller 121 includes a microcomputer. It provides H signal (indicative of an instruction to run the room unit) to the terminal 4 of the connector 120 based on the condition set by a switch 122. The switch 122 may set such parameters as start/stop of the air conditioner, reference room temperature, fan speed (high (H), middle (M), low (L), and automatic mode ("auto")), direction of the output air, running period set in the timer. It should be noted that the switch 122 may be a wireless controller adapted to control some or all of these parameters.

Thermistors 123 and 124 are provided to detect temperature of the air-conditioning room and that of the heat exchanger of the room unit, respectively. The outputs of these thermistors are digitized by A/D converters and supplied to the controller 121 in controlling the air conditioner.

In operation, the air conditioner may be controlled, for example, by comparing the room temperature and a preset reference temperature by means of a comparator and by generating H signal to the terminal 4 of the connector 120 if the difference exceeds a predetermined range, thereby actuating the compressors. The compressors may be stopped by terminating the H signal when the difference has fallen within the predetermined range.

It would be noted that a protective measure may be provided to prevent a re-start of the compressor within a predetermined short period (which ranges from 2 to 3 minutes). This is attained by suppressing the generation of H signal for that period subsequent to the termination of H signal.

The thermistor 124 is adapted to stop the H signal, upon detection of a low temperature signal that indicates excessive refrigeration of the heat exchanger of the room unit, so that freezing of the heat exchanger is prevented.

An electric motor 125 shown in FIG. 15 symbolically represents any one of the similar motors of the fans 16A, 16B, 26, 34A, and 34B belonging to a room unit such as the unit 3A. The motor may be a single phase induction motor having a multiplicity of taps for varying its rotational speed. For example, four taps may be provided for four different speeds which correspond to four blowing levels of the fan, that is, "high" (H), "middle" (M), "low" (L), and "very low" (LL). The "very low" level (LL) may be selected only when the room temperature is in an allowable range of the preset temperature and the compressor is stopped. When the output level of the fan (that is, the blowing power of the fan) is set to "auto" on the switch 122, the output of the fan will be switched from "high" (H) to "middle" (M), and further to "low" (L) in the order mentioned depending upon the difference between the room temperature detected and the preset reference temperature. On the other hand, if the output of the fan is set manually to one of the three levels ("high" (H), "middle" (M), "low" (L)), the fan is powered at the manually set level.

A step motor 126 is provided to change the direction of the air blown out of the outlet of the room unit. By periodically changing the rotational direction of the step motor, the air may be continuously changed in direction.

Figure 16:
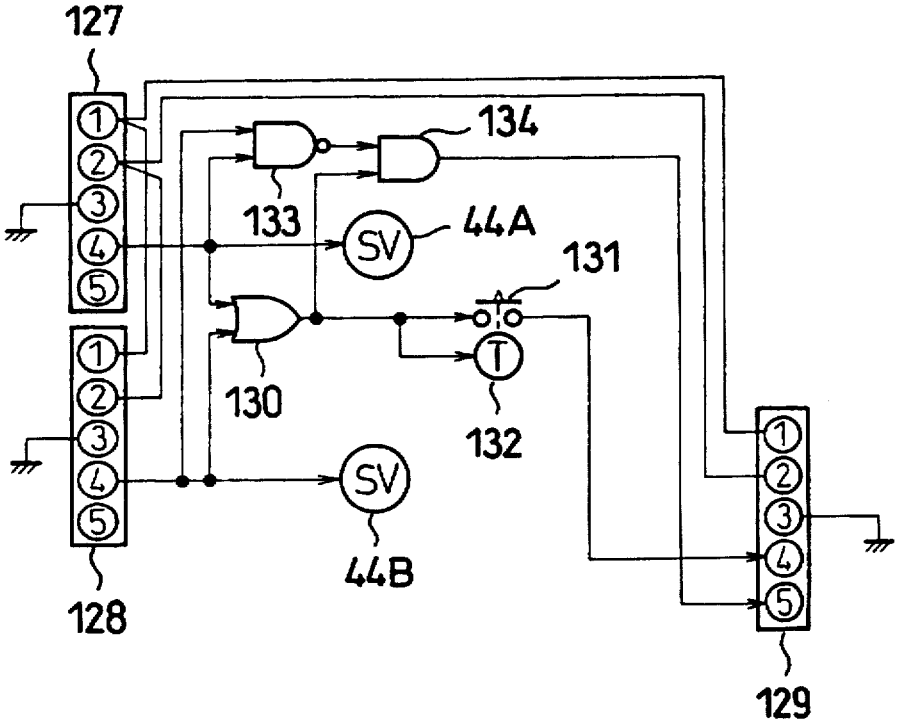
FIG. 16 is a an electric circuit diagram of a branch kit installed inside an electric circuit box accommodated in a second connection box for use in an air conditioner of the invention.

FIG. 16 shows an electric circuit belonging to the electric circuit box 100 housed in the connection box 37. Connectors 127 and 128 are adapted to connect to the connectors 120 of the room units 5A and 5B, respectively, when the terminals of both connectors having the identical reference numbers are coupled each other. Similarly, a connector 129 may be connected to the connector 104 of the outdoor unit 1 by coupling their terminals having the identical numbers together.

The electromagnetic valve 44A is opened when it is energized by an H signal appearing on the terminal 4 of the connector 127, to thereby allowing the refrigerant to pass there through and circulate in the room unit 5A. Similarly, the electromagnetic valve 44B may be opened by an H signal appearing on the terminal 4 of the connector 128, and establish a refrigerant circuit for the room unit 5B. It would be recalled that these H signals are supplied from the room units 5A and 5B to activate the compressor 2B.

An OR gate 130 switches its logical state from Low to High when at least one of the outputs to the terminal 4 of the connectors 127 and the output to the terminal 4 of the connector 128 becomes High. The output "High" (H) of the OR gate 130 is passed to the terminal 4 of the connector 129 via a timer relay switch 131 as an activation signal H for the compressor 2B. The signal is also supplied from the terminal 4 of the connector 129 to the terminal 4 of the connector 104 of the outdoor unit.

The timer relay switch 131 is under control of a timer relay 132. If the output of the OR gate 130 is Low (L), the timer relay 132 causes the timer relay switch 131 to open. Conversely, the timer relay switch 131 will be closed if the output of the OR gate 130 goes High, but only after a predetermined period T1 (which is normally in the range from 2 to 3 minutes) subsequent to the High signal from the OR gate 130. After the period of T1, timer relay switch 131 is closed and remains so until it receives signal Low.

A NAND gate 133 and an AND gates 134 together control the energization of the electromagnetic valve 24B of the outdoor unit based on the input to, and the output of, the OR gate 130, respectively. The AND gate 134 outputs its H signal only when one of the two input signals to the OR gate 130 is high H, which output signal H is supplied to the electromagnetic valve 24B through the terminal 5 of the connector 129 and the terminal 5 of the connector 104 of the outdoor unit. The electromagnetic valve 24B is adapted to control the unloader of the compressor 2B.

In the foregoing arrangement of the invention, if the 1500W compressor 2A is connected to two room units 3A and 3B (each having a refrigeration capacity of 2200W) but only one of them is in operation (generating H signals) and the other is inactive, the electromagnetic valve 14B is opened, which reduces the flow rate through the compressor 2A and hence prevents excessive flow of refrigerant to the running room unit. As a result, the freezing of the heat exchanger of the room unit and a counter flow of the refrigerant back to the compressor 2A are prevented.

It should be noted that both of the controllers 121 of the room units 3A and 3B independently have such protective means as mentioned above for preventing re-start of the compressor within a predetermined period based on the H signals from the room units, so that when only one of the room units 3A and 3B has been electrically disconnected, re-start of the other compressor is prevented by the protective means that it owns.

However, when the two room units 3A and 3B are in operation (that is, they are connected to the outdoor unit to perform refrigeration), it is not possible to prevent the re-start (or re-activation) of the temporarily inactive compressor 2A if the control is based on the H signals from the room units. This is true since H signals from one room unit may arrive independently irrespective of the operating condition of the other. It should be appreciated that the invention overcomes this problem by providing the outdoor unit 1 with a timer relay 108 and a timer relay switch 107 which stops the H signal from the OR gate 106 for a predetermined period, as described in detail below.

Figure 17:
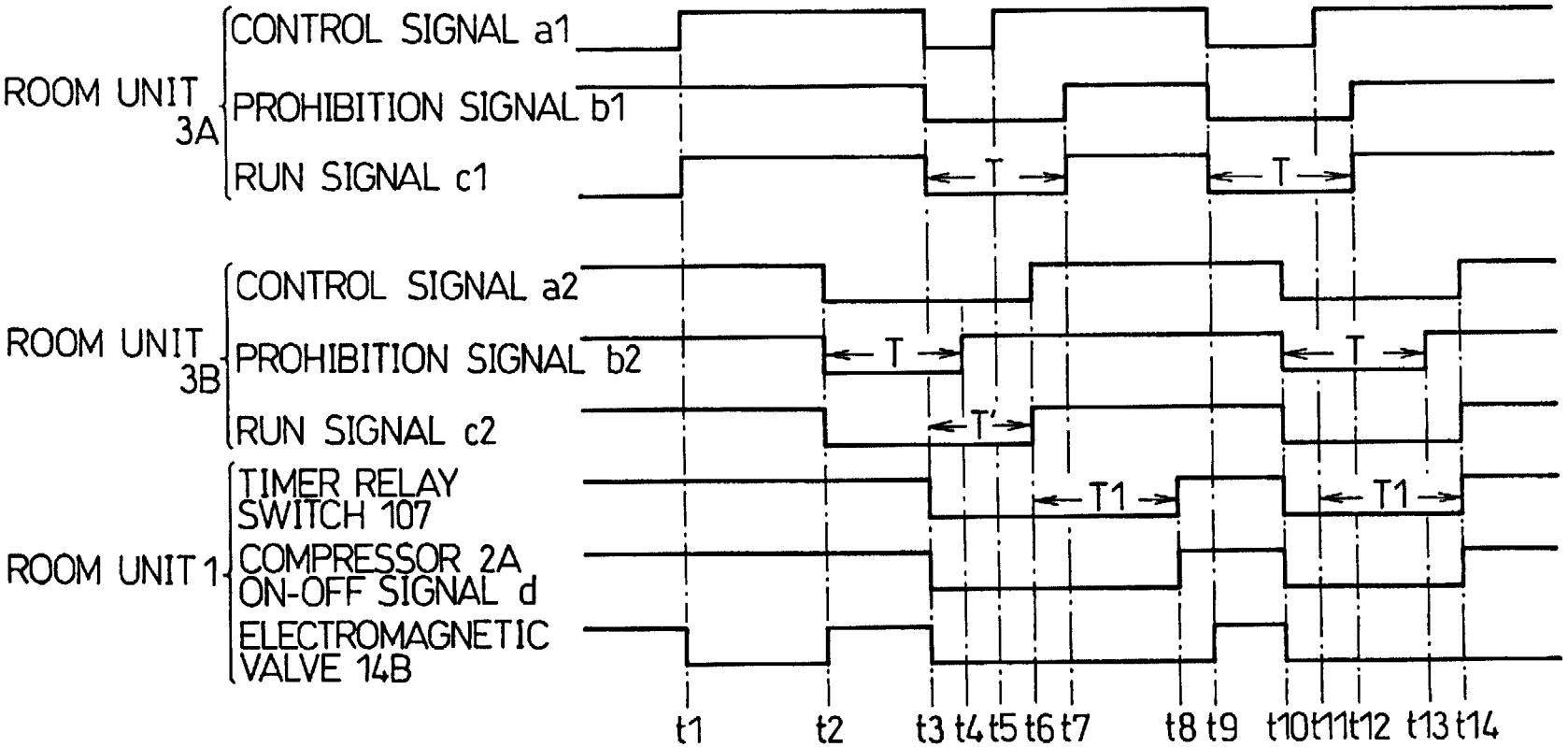
FIG. 17 is timing chart, showing the operation of a compressor of an outdoor unit according to the invention.

FIG. 17 illustrates a timing chart showing how the H signal from the OR gate 106 is suppressed for a given period of time. Suppose, for example, that the controller 121 of the room unit 3A has been generating control signals a1 based on the signal from the switch 122 and/or the temperature sensor, thereby energizing the compressor 2A, and that the control signal a1 goes Low at time t3 in FIG. 17. The controller 121 is adapted to generate, along with the control signal al, prohibition signal b1 which causes the control signal a1 not to be output from the controller 121 for a predetermined period T1 thereafter. Consequently, an activation signal c1, which is a delayed version of control signal a1, is generated. Thus, re-activation of the compressor is possible only a period T1 after the previous cut off of control signal al at time t3. This delayed run signal c1 is supplied to the terminal 4 of the connector 120 which is connected to another connector 102 of the outdoor unit, as shown in FIG. 14. As the signal is input via the terminal 4 of the connector 102 to the OR gate 106, the compressor 2A is activated.

In a similar fashion, when a control signal a2 is supplied from the room unit 3B, but is delayed by a prohibition signal b2, a delayed run signal c2 is input to the OR gate 106 via the terminal 4 of the connector 103, serving as an activation signal for the compressor 2A.

Thus, if only one of the two room units 3A and 3B is in operation, the compressor 2A is re-started only by one signal c1 or c2, so that delay time T (t3–t7, t9–t12, or t2–t4, t10–t13) required by the compressor is secured. However, if the room units 3A and 3B are both in operation, a run signal d supplied from the OR gate 106 is likely to occur within a short period of time T' (t3–t8, t10–t14) less than T, failing to prevent unfavorable re-start.

In order to prevent this problem, an air conditioner of the invention is provided with a timer relay switch 107 in series with the compressor 2A as shown in FIG. 14. The timer relay switch 107, and hence the compressor 2A, is enabled only after the period T has elapsed (t6–t8, t11–t14) subsequent to the generation of an ON signal by the OR gate 106, thereby preventing short time re-start of the compressor 2A. Thus, the problematic re-start of the compressor 2A can be prevented by a combination of the timer relay 108 and the timer relay switch 107 provided in the outdoor unit 1, without changing the control circuits of the room units 3A and 3B. It should be noted that this arrangement allows multiple room units to be safely connected to one compressor of the outdoor unit even when the room units are standard units equipped with microcomputers.

On the other hand, electromagnetic valve 14B is opened for a period shown in FIG. 17 (a period up to t1, t2–t3, t9–t10) and causes the compressor 2A to be unloaded, based on the exclusive OR of the run signal c1 and c2 that appear at the terminals 4 of the connectors 102 and 103, respectively, of the outdoor unit 1.

Normally when a single room unit 4 (having refrigeration capacity of 5200W) is connected to the compressor 2B (having a nominal power of 1700W), the room unit is connected to the compressor via the connection box 29. In this case the electromagnetic valve 24B of the outdoor unit 1 remains closed. The compressor 2B is energized only by the run signal from the room unit 4.

On the other hand, when the two room units 5A and 5B (each having refrigeration capacity of 2200 W) are connected to the outdoor unit 1 via the electric circuit box 100 in the connection box 37 mounted on the outdoor unit 1, these room units may operate in the same way as the two room units 3A and 3B described above. In this case the electromagnetic valves 44A and 44B for controlling the flow rate of the refrigerant to the room units 5A and 5B are provided in the electric circuit box 100, and the electromagnetic valve 24B (installed in the outdoor unit 1) for loading/unloading the compressor 2B is controlled by the signal from the electric circuit box 100. Corresponding to the timer relay 108 and its timer relay switch 107 for controlling the re-start of the compressor 2A, a timer relay 132 and its timer relay switch 131 are provided in controlling the re-start of the compressor 2B.

Although the invention has been described by way of example for preferred air conditioners, it will be understood that various change may be made within the scope of the appended claims.

What is claimed is:

1. An air conditioner comprising:

an outdoor unit having at least one compressor, at least one heat exchanger, at least one expansion device, and tube connectors;

at least one room unit having a heat exchanger and tube connectors; and refrigerant tubes for connecting said room unit with said outdoor unit to form a refrigerant circuit, wherein said outdoor unit is adapted to be selectively connected to said at least one room unit via a first connection box having refrigerant tubes for connecting said compressor to said room unit; and a casing for accommodating therein said refrigerant tubes, and said at least one room unit via a second connection box having a multiplicity of branching refrigerant tubes having a multiplicity of branches each equipped with a valve and a expansion device, and adapted to branch said refrigerant into said room units connected thereto; and a second casing accommodating said branching refrigerant tubes, said first and second connection boxes mountable on an exterior wall of said outdoor unit.

2. The air conditioner as claimed in claim 1, wherein said outdoor unit has at least one fan for enhancing heat exchange between said heat exchanger of said outdoor unit and the ambient air; and said second connection box is mounted on an exterior wall of said outdoor unit and in a passage of air blown by said fan.

3. The air conditioner as claimed in claim 2, wherein said second connection box is mounted on the exterior of said outdoor unit such that a central portion of the air blown out of said heat exchanger is provided with a free space extending at least over predetermined dimensions.

4. The air conditioner as claimed in claim 1, wherein said second connection box has:

a casing in the form of thin book having four sides between two large rectangular faces, with a first side thereof facing said tube connectors of said outdoor unit;

a branching tube having branches for branching the flow of the refrigerant, said branch each having a valve for controlling the flow rate of the refrigerant through said branch and expansion device;

a set of tube connectors (first connectors) formed on a first one of said four sides, for connecting said multiplicity of room units;

a second tube connector having a connector which is adapted to connect to said one compressor and mounted on a second side adjacent to said first side, and wherein said connection box is adapted to mount on an exterior wall of said outdoor unit.

5. The air conditioner as claimed in claim 4, wherein said end of said second tube connector is mounted in a cut formed in one corner of said second side facing a third side.

6. The air conditioner as claimed in claim 1, wherein said room unit is provided with a signal generator for generating an ON/OFF control signal based on the comparison of current room temperature with a predetermined reference temperature; and a first delay circuit for delaying the output of said ON/OFF signal for a predetermined period of time subsequent to the generation of said ON/OFF signal, and wherein said outdoor unit is provided with an AND gate for receiving said ON/OFF signals from said multiplicity of room units and for generating a signal indicative of its logical sum; and a second delay circuit for delaying output of said ON/OFF control signal over a period between an OFF signal indicative of said logical sum and a first ON signal subsequent to said OFF signal indicative of said logical sum.

7. The air conditioner as claimed in claim 6, wherein a connector is installed in one of the connection boxes which includes a branching tube having branches each equipped with a valve, a expansion device, and a connector, for connecting a multiplicity of room units to the single compressor of said outdoor unit, said connection box mounted on an exterior wall of said outdoor unit.

8. The air conditioner as claimed in claim 1, wherein said outdoor unit has a first and a second compressors having different heat capacities such that a first compressor having a smaller power is adapted to connect with two room units via a branching tube having two branches each having a expansion device while a second compressor having a larger power is adapted to connect to either:

a tube having a expansion device for connecting a single room unit having a large power, and p2 a branching tube having a expansion device and a valve in each of the branches for connecting two room units having small heat capacities.

9. The air conditioner as claimed in claim 8, wherein said air conditioner is adapted to accept on an exterior wall of said outdoor unit either:

the first connection box accommodating a expansion device to be connected to said second compressor, and having a tube connector for connecting a single room unit to said second compressor, or the second connection box accommodating a branching tube having branches having a valve, a expansion device, and a connector for connecting two room units to said second compressor.

10. An air conditioner comprising:

an outdoor unit having at least one compressor, at least one heat exchanger, at least one expansion device, and tube connectors; at least one room unit having a heat exchanger and tube connectors; and refrigerant tubes for connecting said room unit with said outdoor unit to form a refrigerant circuit, wherein said outdoor unit is adapted to be connected to said at least one room unit via a connection box having means for disabling said expansion device;

a multiplicity of branching refrigerant tubes having a multiplicity of branches each equipped with a valve and a expansion device, and adapted to branch said refrigerant into said at least one room unit connected thereto; and a casing accommodating said branching refrigerant tubes, said connection box mountable on an exterior wall of said outdoor unit.

11. The air conditioner as claimed in claim 10, wherein said means for disabling said expansion device has a by-pass tube by-passing said expansion device and connecting to said refrigerant tube of said outdoor unit; and an opening/closing means provided in said by-pass tube.

12. The air conditioner as claimed in claim 11, wherein said outdoor unit has electrical connectors for electrically connecting said outdoor unit with said multiplicity of room units;

said opening/closing means is an electromagnetic valve adapted to close when a single room unit is electrically connected to said electrical connectors but open when a multiplicity of room units are electrically connected to said electrical connectors.

13. The air conditioner as claimed in claim 10, wherein said means for disabling said expansion device comprises a by-pass tube by-passing said expansion device; and a three-way tube for selectively connecting said by-pass tube and said expansion device to said tube connectors of said outdoor unit.

14. The air conditioner as claimed in claim 10, further comprising a second connection box having:

a casing in the form of thin book having four sides between two large rectangular faces, with a first side thereof facing said tube connectors of said outdoor unit;

a branching refrigerant tube for branching the flow of the refrigerant, said branching tube having a multiplicity of valves for controlling the flow rates of the refrigerant through said branches, and expansion devices;

a set of tube connectors (first connectors) formed on a first one of said four sides, for connecting said multiplicity of room units;

a second tube connector mounted on a second side adjacent to said first side, for connecting to said one compressor, and wherein said connection box is adapted to mount on an exterior wall of said outdoor unit.

15. The air conditioner as claimed in claim 14, wherein said second tube connector has an end mounted in a cut formed in one corner of said second side facing a third side.

16. The air conditioner as claimed in claim 10, wherein said room unit is provided with a signal generator for generating an ON/OFF control signal based on the comparison of current room temperature with a predetermined reference temperature; and a first delay circuit for delaying the output of said ON/OFF signal for a predetermined period of time subsequent to the generation of said ON/OFF signal, and wherein said outdoor unit is provided with an AND gate for receiving said ON/OFF signals from said multiplicity of room units and for generating a signal indicative of its logical sum; and a second delay circuit for delaying output of said ON/OFF control signal over a period between an OFF signal indicative of said logical sum and a first ON signal subsequent to said OFF signal indicative of said logical sum.

17. The air conditioner as claimed in claim 16, wherein a second connector is installed in a connection box which includes a branching tube having branches each equipped with a valve, a expansion device, and a connector, for connecting a multiplicity of room units to the single compressor of said outdoor unit, said connection box mounted on an exterior wall of said outdoor unit.

18. The air conditioner as claimed in claim 10, wherein said outdoor unit has a first and a second compressors having different heat capacities such that a first compressor having a smaller power is adapted to connect with two room units via a branching tube having two branches each having a expansion device while a second compressor having a larger power is adapted to connect to either:

a tube having a expansion device for connecting a single room unit having a large power, and a branching tube having a expansion device and a valve in each of the branches for connecting two room units having small heat capacities.

19. The air conditioner as claimed in claim 18, wherein said second connection box includes:

means for disabling said expansion device;

a branching refrigerant tube having two branches each equipped with a valve, a expansion device, and a connector, for connecting said second compressor to two room units, and wherein said second connection box is adapted to be mounted on an exterior wall of said outdoor unit.

* * * * *